US009843858B1

(12) United States Patent
Karunasiri et al.

(10) Patent No.: US 9,843,858 B1
(45) Date of Patent: Dec. 12, 2017

(54) DIRECTION FINDING SYSTEM USING MEMS SOUND SENSORS

(71) Applicant: The United States of America, as represented by the Secretary of the Navy, Washington, DC (US)

(72) Inventors: Gamani Karunasiri, Pacific Grove, CA (US); Fabio Alves, Marina, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/634,079

(22) Filed: Jun. 27, 2017

Related U.S. Application Data

(60) Provisional application No. 62/409,612, filed on Oct. 18, 2016.

(51) Int. Cl.
*H04R 3/00* (2006.01)
*H04R 19/04* (2006.01)
(Continued)

(52) U.S. Cl.
CPC ..... *H04R 1/406* (2013.01); *H04R 19/005* (2013.01); *H04R 2201/003* (2013.01)

(58) Field of Classification Search
CPC ..... H04R 19/04; H04R 1/406; H04R 3/005; H04R 9/08
(Continued)

(56) References Cited

U.S. PATENT DOCUMENTS 8,467,548 B2 6/2013 Karunasiri et al.
2011/0299701 A1* 12/2011 Karunasiri ..... H04R 19/04 381/92

OTHER PUBLICATIONS

Touse et al., "Fabrication of a microelectromechanical directional sound sensor with electronic readout using comb fingers," Applied Physics Letters 96 (2010).

(Continued)

*Primary Examiner* — George Monikang
(74) *Attorney, Agent, or Firm* — Naval Postgraduate School; James B. Potts

(57) ABSTRACT

Provided is a Direction Finding Acoustic Sensor comprising a first sound sensor and a second sound sensor, where the first and second sound sensors are generally maintained in a reflectional symmetry around an axis of symmetry. A digital device in data communication both sound sensors receives a signal $P_L$ from the first sensor a signal $P_R$ from the second sensor based on displacement respective sensors. The digital device evaluates a difference between an $\alpha_1 P_L$ and an $\alpha_2 P_R$ relative to a sum of the $\alpha_1 P_L$ and the $\alpha_2 P_R$, and provides an angle $\theta_S$ corresponding to the result. Typically, the Direction Finding Acoustic Sensor communicates the $\theta_s$ determined using some appropriate reference frame, such as the axis of symmetry. The Direction Finding Acoustic Sensor is capable of providing an unambiguous direction within an angle of $\pm(90°-\theta_{off})$ of the axis of symmetry.

15 Claims, 12 Drawing Sheets

(51) Int. Cl.
*H04R 9/08* (2006.01)
*H04R 1/40* (2006.01)
*H04R 19/00* (2006.01)

(58) Field of Classification Search
USPC ..... 381/92, 111–115, 122
See application file for complete search history.

(56) References Cited

OTHER PUBLICATIONS

Downey et al, "Reduced Residual Stress Curvature and Branched Comb Fingers Increase Sensitivity of MEMS Acoustic Sensor," Journal of Micromechanical Systems 23(2) (2014).
Touse, "Design, fabrication, and characterization of a microelectromechanical directional microphone," (Ph.D. dissertation, Naval Postgraduate School, 2011), available at http://calhoun.nps.edu/handle/10945/10762, last accessed Jun. 28, 2017.
Davis, "Characterization of the MEMS directional sound sensor in the high frequency (15-20 kHz) range," (M.S. thesis, Naval Postgraduate School, 2011), available at http://calhoun.nps.edu/handle/10945/10588, last accessed Jun. 28, 2017.
Dritsas, "Characterization of the MEMS directional sound sensor fabricated using the SOIMUMPs process," (M.S. thesis, Naval Postgraduate School, 2008), available at http://calhoun.nps.edu/handle/10945/4073, last accessed Jun. 28, 2017.
Muamad, "Characterization of MEMS a directional microphone with solid and perforated wings," (M.S. thesis, Naval Postgraduate School, 2009), available at http://calhoun.nps.edu/handle/10945/4695, last accessed Jun. 28, 2017.
Akcakaya et al., "Performance analysis of the Ormia ochracea's coupled ears," J. Acoust. Soc. Am. 124 (4) (2008).
Yoo et al., "Fabrication of biomimetic structured diaphragms," Sensors and Actuators A 97-98 (2002).
Saito et al., "Micro gimbal diaphragm for sound source localization with mimicking Ormia Ochracea," Proceedings of the 41st SICE Annual Conference Society for Instrument and Control Engineers (SICE) 4,2159-2162 (2002).
Miles et al., "A low-noise differential microphone inspired by the ears of the parasitoid fly Ormia ochracea," J. Acoust. Soc. Am. 125 (2009).
Bicen et al., "Integrated optical displacement detection and electrostatic actuation for directional optical microphones with micromachined biomimetic diaphragms," IEEE Sens. J. 9 (2009).
Miles et al., "The development of a biologically-inspired directional microphone for hearing aids," Audiol. Neuro-otol. 11 (2006).
Touse et al., "MEMS directional sound sensor with simultaneous detection of two frequency bands," Sensors 2010 IEEE 1, (2010).
Chen et al., "Physical Analysis of a Biomimetic Microphone with a Central-Supported (C-S) Circular Diaphragm for Sound Source Localization," IEEE Sens. J. 12 (2012).
Liu et al., "Understanding and mimicking the dual optimality of the fly ear," Sci. Rep. 3 (2013).
Kuntzman et al., "Sound source localization inspired by the ears of the Ormia ochracea," Appl. Phys. Lett. 105, (2014).
Kuntzman et al., "Micromachined In-Plane Pressure-Gradient Piezoelectric Microphones," IEEE Sens. J. 15 (2015).
Miles et al., "A MEMS Low-Noise Sound Pressure Gradient Microphone with Capacitive Sensing," J. MEMS 24 (2015).
Klose et al., "Fluidmechanical Damping Analysis of Resonant Micromirrors with Out-of-plane Comb Drive." Proc. COMSOL Conf 2008, Hanover, Germany (2008).
Miles,"Mechanically coupled ears for directional hearing in the parasitoid fly Ormia ochracea," The Journal of the Acoustical Society of America 98 (1995).
Liu et al., "Biomimetic optical directional microphone with structurally coupled diaphragms," Appl. Phys. Left. 93 (2008).
Zhang et al., "Frequency dependent fluid damping of micro/nano flexural resonators: Experiment, model and analysis," Sensors and Actuators A 134 (2007).

* cited by examiner

PRIOR ART

DIRECTION FINDING SYSTEM USING MEMS SOUND SENSORS

RELATION TO OTHER APPLICATIONS

This patent application claims priority from provisional patent application 62/409,612 filed Oct. 18, 2016, which is hereby incorporated by reference in its entirety.

FIELD OF THE INVENTION

One or more embodiments relates to a Direction Finding Acoustic Sensor for determining a direction of an incident sound.

BACKGROUND

Acoustic direction finding is the task of finding the direction of a sound source given measurements of the sound field. The sound field can be described using physical quantities like sound pressure and particle velocity. A typical approach in artificial systems is to utilize two (or more) microphones and evaluate a difference of arrival times or pressure, allowing mathematical estimation of the direction of the sound source. However, the accuracy of these systems is fundamentally limited by the physical size of the array. Generally, if the array is too small, then the microphones are spaced so closely that interaural time differences approach zero, making it extremely difficult to estimate the orientation. As a result, effective microphone arrays may become cumbersome and impractical for use on smaller mobile platforms, or as a personal device.

Animals similarly use their hearing to identify the direction of an auditory stimulus when both of the ears are excited by a sound wave, based on differences in arrival times and in the intensity of the sound between the nearest and the furthest ear. In the case of large animals, differences in intensity and the arrival time are relatively large and easily detected. However, smaller animals, experience small interaural differences. As a result, many small animals have developed mechanisms for effectively increasing these differences before the sound stimulus reaches the auditory cells.

This behavior as served as the inspiration for development of small-dimensioned, microelectromechanical direction finding sensors. See e.g., U.S. Pat. No. 8,467,548 to Karunasiri et al., issued Jun. 18, 2013. This particular sensor provides localization of sound sources using sensors much smaller than the wavelength detected, by utilizing bending mode stimulated by the effect of incident sound pressure on the sensors wings. However, the symmetric response of the sensor makes the determination of bearing ambiguous.

Similar bearing ambiguity in sound direction systems is not a new issue, and various solutions are typically utilized. The problem of bearing ambiguity can be resolved by altering the position of a sensor relative to a sound location, for example, maneuvering a ship to provide a different geographic location of reception. These two techniques can work well as long as the target has not moved significantly before and after re-location, but they can lead to inaccurate conclusions if the sound source is moving at a relatively high speed, and additionally incurs an obvious delay in location while the sensor is relocated. Such a delay may be unacceptable or highly impractical in certain situations, such as a first responder or soldier attempting to locate a source of apparent gunfire.

It would be advantageous to provide an acoustic direction finding system which could be easily deployed on smaller mobile platforms or as a personal device, and which allowed relatively instantaneous direction finding without delays associated with necessary relocation of the sound sensor. Such as system would be highly useful for first responders, soldiers, and others, as well as for smaller, mobile robotic or other units which might seek to employ such direction finding for navigational purposes.

These and other objects, aspects, and advantages of the present disclosure will become better understood with reference to the accompanying description and claims.

SUMMARY

The disclosure provides a Direction Finding Acoustic Sensor comprising a first sound sensor and a second sound sensor, where each sound sensor comprises a left wing, a right wing, and a bridge coupling the left wing and right wing. For each individual sensor, a first sensor axis intersects both the left wing and the right wing, and a second sensor axis is perpendicular to the first sensor axis. The sound sensors comprise a support structure allowing oscillation under sound excitation, and each sound sensor additionally comprises an amplitude detection device adapted to detect a displacement of the sensor wings.

The Direction Finding Acoustic Sensor further comprises a platform structure coupled to each sound sensor and maintaining the sound sensors in respective orientations such that the second sensor axes of the sound sensors generally have a reflectional symmetry around an axis of symmetry. The reflectional symmetry generally establishes an angle $\theta_{off}$ between the first sensor axis of each sensor and a horizontal axis, where the horizontal axis is perpendicular to the axis of symmetry. In some embodiments, the second sensor axes of the respective sound sensors are co-planer with the axis of symmetry, and in further embodiments, the first sensor axes of the respective sound sensors are co-planer with the axis of symmetry.

The Direction Finding Acoustic Sensor further comprises a digital device in data communication with the amplitude detection devices of each sound sensor. The digital device is programmed to receive a signal $P_L$ from a first amplitude detection device and a signal $P_R$ from a second amplitude detection device, which indicate displacement of the sensor wings of each sound sensor. The digital device is programmed to perform direction finding by evaluating a fraction where the numerator of the fraction comprises the difference between an $\alpha_1 P_L$ and an $\alpha_2 P_R$ and the denominator of the fraction comprises the sum of the $\alpha_1 P_L$ and the $\alpha_2 P_R$, where $\alpha_1$ and $\alpha_2$ are non-zero real numbers, and determining an angle $\theta_s$ corresponding to the result. Digital device is further programmed to communicate the $\theta_s$ determined using an appropriate reference frame, such as the axis of symmetry, or some other reference. In a particular embodiment, $\theta_s$ provides an unambiguous direction within an angle of $\pm(90°-\theta_{off})$ of the axis of symmetry.

The novel apparatus and principles of operation are further discussed in the following description.

Embodiments in accordance with the invention are further described herein with reference to the drawings.

DETAILED DESCRIPTION OF THE INVENTION

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a Direction Finding Acoustic Sensor for determining a direction of an incident sound using a first sound sensor and a second sound sensor having general reflectional symmetry around an axis of symmetry.

The disclosure provides Direction Finding Acoustic Sensor comprising a first sound sensor and a second sound sensor, where the first and second sound sensors are generally maintained in a reflectional symmetry around an axis of symmetry. A digital device is in data communication both sounds sensors and programmed to receive a signal $P_L$ from a first amplitude detection device and a signal $P_R$ from a second amplitude detection device based on displacement of the sensor wings of each sound sensor. The digital device performs direction finding by evaluating a difference between an $\alpha_1 P_L$ and an $\alpha_2 P_R$ relative to a sum of the $\alpha_1 P_L$ and the $\alpha_2 P_R$, where $\alpha_1$ and $\alpha_2$ are non-zero real numbers. The Direction Finding Acoustic Sensor provides an angle $\theta_S$ corresponding to the result. Typically, the Direction Finding Acoustic Sensor communicates the $\theta_s$ determined using some appropriate reference frame, such as the axis of symmetry. The Direction Finding Acoustic Sensor is capable of providing an unambiguous direction within an angle of $\pm(90°-\theta_{off})$ of the axis of symmetry.

Figure 1:
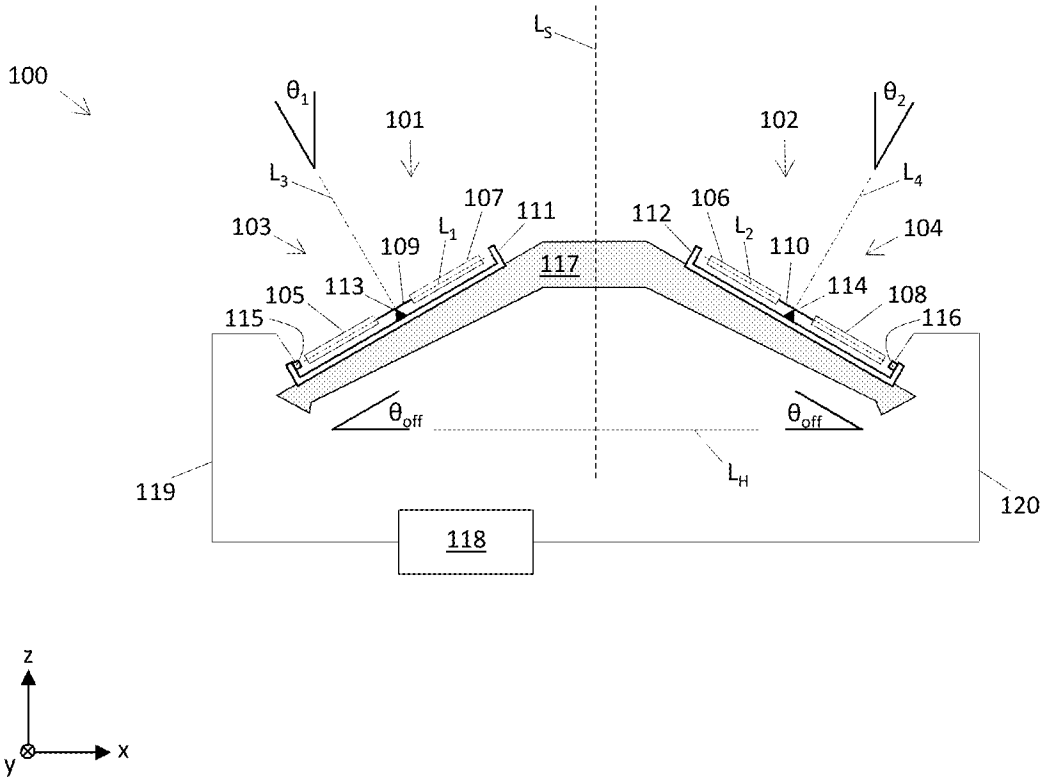
FIG. 1 illustrates an embodiment of the Direction Finding Acoustic Sensor.

FIG. 1 illustrates an embodiment of a Direction Finding (DF) Acoustic Sensor generally indicated at 100. The DF sensor 100 comprises a first sound sensor generally indicated at 101 and a second sound sensor generally indicated at 102. The first sound sensor 101 comprises a sensor body indicated as 103, with sensor body 103 comprising left wing 105, right wing 107, and a bridge 109 coupling with left wing 105 and right wing 107. Typically, bridge 109 is fixably attached to left wing 105 and right wing 107. A first sensor axis $L_1$ intersects both left wing 105 and right wing 107 of first sound sensor 101, as illustrated. A second sensor axis $L_3$ is perpendicular to first sensor axis $L_1$. Typically, the first sensor axis $L_1$ is substantially parallel to one or more of left wing 105, right wing 107, and bridge 109 of first sound sensor 101, and second sensor axis $L_3$ is substantially perpendicular to one or more of left wing 105, right wing 107, and bridge 109 of first sound sensor 101. Reference axes are additionally illustrated at FIG. 1, with x and z axes as shown and the y axis proceeding into the page. In a particular embodiment, first sensor axis $L_1$ of first sound sensor 101 is substantially co-planer with the x-z plane and substantially perpendicular to the y axis. First sound sensor 101 further comprises support structure 111 connected to sensor body 103. Support structure 111 is hollow beneath sensor body 103 and allows sensor body 103 to oscillate under sound excitation with air damping. First sound sensor 101 further comprises an amplitude detection device 115 adapted to detect a displacement of left wing 105 relative to support structure 111. In some embodiments, amplitude detection device 115 is adapted to detect a displacement of right wing 107, and in other embodiments, both left wing 105 and right wing 107.

The second sound sensor 102 comprises generally equivalent components arranged in the same fashion. Second sound sensor 102 comprises sensor body 104 having left wing 106, right wing 108, and bridge 110 coupling the two wings. Similar to before, a first sensor axis $L_2$ of second sound sensor 102 intersects both left wing 106 and right wing 108 of second sound sensor 102, and second sensor axis $L_4$ of second sound sensor 102 is perpendicular to first sensor axis $L_2$, with typically $L_2$ substantially parallel to and $L_4$ substantially perpendicular to one or more of left wing 106, right wing 108, and bridge 110 of second sound sensor 102. In certain embodiments, first sensor axis $L_2$ of second sound sensor 102 is substantially co-planer with the x-z plane and substantially perpendicular to the y axis. A support structure 112 connects to and is hollow beneath sensor body 104 to allow sensor body 104 to oscillate under sound excitation with air damping, and second sound sensor 102 additionally comprises an amplitude detection device 116 to detect a displacement of right wing 108 relative to support structure 112, with amplitude detection device 116 detecting a displacement of left wing 106 in some embodiments and both right wing 108 and left wing 106 in other embodiments.

Figure 2:
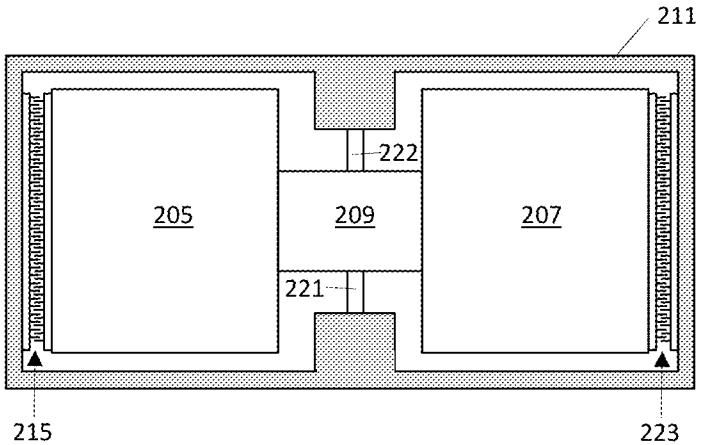
FIG. 2 illustrates an embodiment of an individual sensor comprising the Direction Finding Acoustic Sensor.

Such sound sensors are known in the art. See e.g., U.S. Pat. No. 8,467,548 to Karunasiri et al., issued Jun. 18, 2013, and see Touse et al., "Fabrication of a microelectromechanical directional sound sensor with electronic readout using comb fingers," *Applied Physics Letters* 96 (2010), and see Wilmott et al., "Bio-Inspired Miniature Direction Finding Acoustic Sensor," *Scientific Reports* 6 (2016), all of which are incorporated by reference. In brief and referencing FIG. 2, the sound sensor is generally a micro-electro-mechanical system (MEMS) structure which forms a monolithic sensor in which the left wing 205 and the right wing 207 are coupled through bridge 209, with bridge 209 attached to support 211 through a first leg 221 and a second leg 222. Sensor wings 205 and 206, bridge 209, and legs 221 and 222 are arranged relative to support 211 such that the sensor wings 205 and 206 generate cantilever-type motion fixed at bridge 209 when subjected to incident sound, effectively converting the sound to mechanical motion by forcing the cantilevers to move in a generally normal direction. Typically interdigitated comb fingers attached to the ends of the wings such as those indicated at 215 and 223 convert the mechanical motion into an electrical signal as the capacitance between these fingers and the fixed substrate fingers varies with the motion of the wings. The wings generally respond to incident sound in both rocking and bending modes, with the rocking mode driven by a differential pressure between the two wings while the bending mode is driven by full sound pressure incident on both wings. The device typically generates much larger amplitudes in the bending mode motion and the amplitude of the bending motion is proportional to the net sound pressure at the sensor. Consequently, the directional response exhibits cosine dependence, as observed experimentally. The sensor has a predictable response to excitation represented by:

$$P=|\alpha P_0 \cos\theta| \quad (1)$$

where P is a sensor readout reporting displacement of the wings relative to the support, $\alpha$ is a normalization constant applied according to sensor baseline readings, $P_o$ is the amplitude of the incoming sound pressure, and $\theta$ is the direction of arrival with respect to a normal, such as $L_3$ of first sound sensor 101. Direction with a single sensor additionally requires an omnidirectional microphone to determine the amplitude of the incident sound pressure. The single sound sensor performs adequately to provide the direction of sound ($\theta$) in 0 to 90° range from the normal, however there is an ambiguous angle result at $-\theta$ due to the symmetry of the response.

The Direction Finding Acoustic Sensor 100 illustrated at FIG. 1 operates to solve both the necessity of an embedded omnidirectional microphone and the ambiguity resulting from the symmetric response of a single sensor. At FIG. 1, a platform structure 117 is coupled to first sound sensor 101 and second sound sensor 102 and maintains first sound sensor 101 and second sound sensor 102 in respective orientations such that the second sensor axis $L_3$ of first sound sensor 101 and the second sensor axis $L_4$ of second sound sensor 102 generally have a reflectional symmetry around an axis of symmetry, such as $L_S$. The reflectional symmetry establishes an angle $\theta_1$ between the axis of symmetry $L_S$ and second sensor axis $L_3$ of first sound sensor 101, and an angle $\theta_2$ between the axis of symmetry $L_S$ and second sensor axis $L_4$ of second sound sensor 102, with the angle $\theta_1$ equal or substantially equal to the angle $\theta_2$. By virtue of second sensor axis $L_3$ perpendicular to first sensor axis $L_1$ of first sound sensor 101, and second sensor axis $L_4$ perpendicular to first sensor axis $L_2$ of second sound sensor 102, and due to the general reflectional symmetry, the angles $\theta_1$ and $\theta_2$ are generally equal to an angle $\theta_{off}$, delineated relative to an axis $L_H$, where $L_H$ is perpendicular to the axis of symmetry $L_S$. As indicated at FIG. 1, $\theta_{off}$ is an angle subtended between $L_H$ and first sensor axis $L_1$ of first sound sensor 101, and also subtended between $L_H$ and first sensor axis $L_2$ of second sound sensor 102. In a particular embodiment, platform structure 117 maintains first sound sensor 101 and second sound sensor 102 such that $|\theta_1-\theta_2|$ is less than 10 degrees, preferably less than 5 degrees, and more preferably less than 1 degree. In another embodiment, $L_H$ and $L_S$ are substantially co-planer with the x-z plane, and $\theta_{off}$ is an angle subtended in the x-z plane. In a further embodiment, the second sensor axis $L_3$ of first sound sensor 101, the second sensor axis $L_4$ of second sound sensor 102, and the axis of symmetry $L_S$ are co-planer lines.

As illustrated at FIG. 1, Direction Finding Acoustic Sensor 100 further comprises a digital device 118 in data communication with amplitude detection device 115 of first sound sensor 101 and in data communication with amplitude detection device 116 of second sound sensor 102. The data communication may accomplished through means known in the art, such as the data lines 119 and 120 illustrated at FIG. 1, or through wireless communications, or other methods utilized to pass a signal from a detector to a digital device. Digital device 118 is programmed to receive a signal $P_L$ from amplitude detection device 115 indicating a displacement of a component within sensor body 103, and to receive a signal $P_R$ from amplitude detection device 116 indicating a displacement of a component within sensor body 104. At FIG. 1, digital device 118 is configured to receive a $P_L$ indicating displacement of left wing 105 of first sound sensor 101 and a $P_R$ indicating a displacement of right wing 108 of second sound sensor 102, however as indicated previously, $P_L$ and $P_R$ may also originate from right wing 107 and left wing 106 respectively, or from both wings of the first sensor 101 and second sensor 102.

On receiving the $P_L$ and $P_R$ signals, digital device 118 is programmed to perform direction finding by evaluating a fraction where the numerator of the fraction comprises the difference between an $\alpha_1 P_L$ and an $\alpha_2 P_R$ and the denominator of the fraction comprises the sum of the $\alpha_1 P_L$ and the $\alpha_2 P_R$, where $\alpha_1$ and $\alpha_2$ are non-zero real numbers, and determining an angle $\theta_S$ corresponding to the result. Typically, digital device 118 evaluates a ratio determined by the difference $(\alpha_1 P_L-\alpha_2 P_R)$ divided by the sum $(\alpha_1 P_L+\alpha_2 P_R)$, and determines the angle $\theta_S$ from the result, where $\theta_S$ is a range of $\pm(90°-\theta_{off})$ of the axis of symmetry $L_S$. The coefficients $\alpha_1$ and $\alpha_2$ are both non-zero real numbers which normalize response and generally arise through instrument calibration. In a typical embodiment where first sound sensor 101 and second sound sensor 102 have generally equivalent fabrication, $0.9\leq\alpha_1/\alpha_2\leq1.1$, although this is not a strict requirement. The coefficients $\alpha_1$ and $\alpha_2$ may differ significantly in magnitude based on the individual constructions of first sound sensor 101 and second sound sensor 102. Digital device 118 is further programmed to communicate the $\theta_s$ determined using an appropriate reference frame. For example, $\theta_s$ might be communicated relative to the axis of symmetry $L_S$, or some other reference such as the direction of local earth magnetic field. In a particular embodiment, $\theta_s$ provides an unambiguous direction within an angle of $\pm(90°-\theta_{off})$ of the axis of symmetry $L_S$. The first and second sound sensors arranged as described thereby form a dual sensor assembly which can solve the ambiguity challenge with minimal post-processing.

Figure 3:
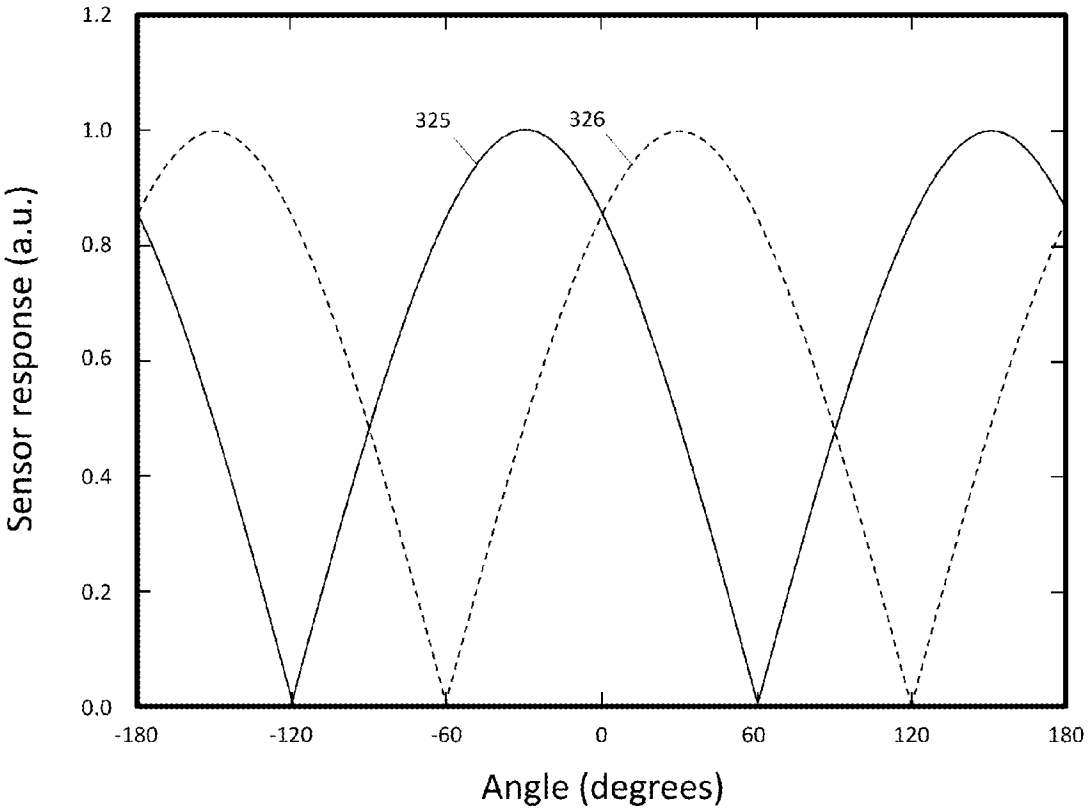
FIG. 3 illustrates an exemplary response of individual sensors comprising the Direction Finding Acoustic Sensor.
Figure 4:
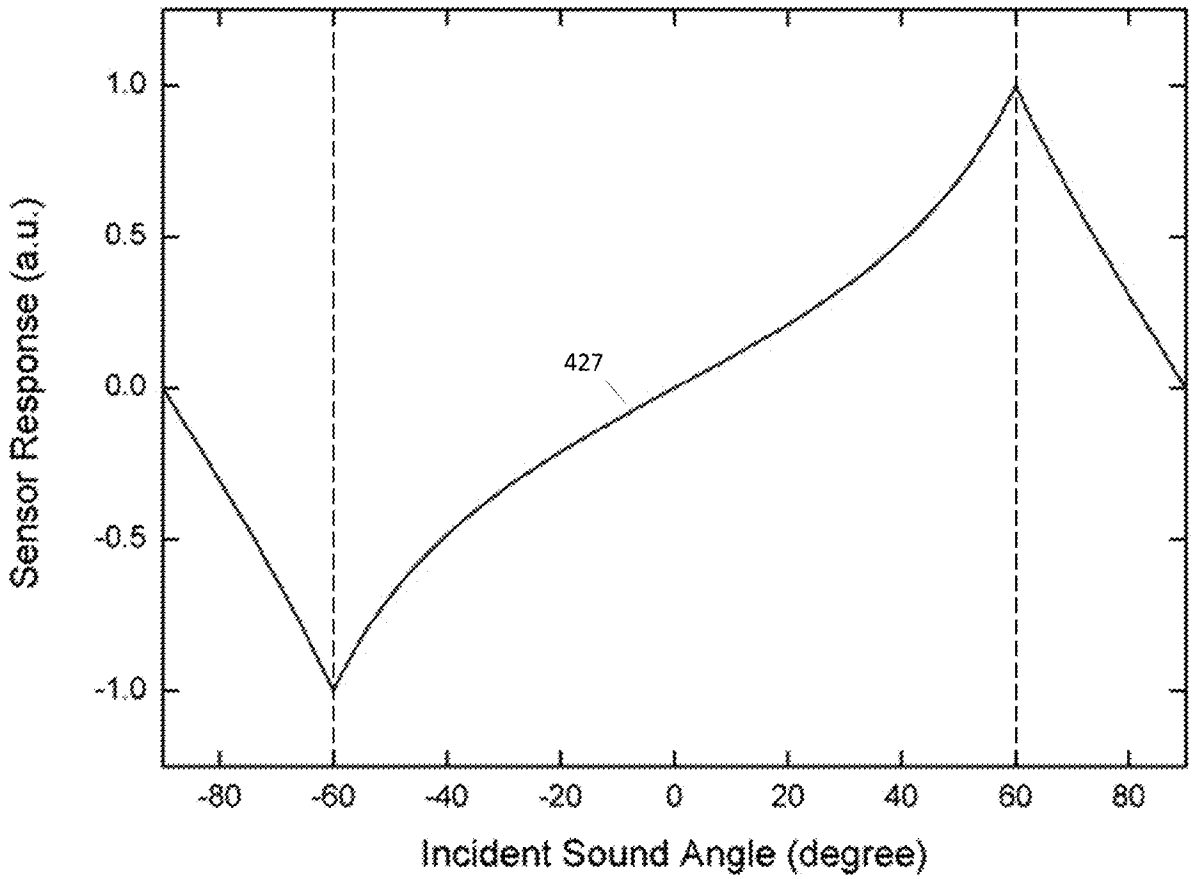
FIG. 4 illustrates a response of the Direction Finding Acoustic Sensor.

For background, FIG. 3 shows the theoretical normalized response to an incident sound of two individual sensors arranged with an offset angle of $\theta_{off}=30°$, and based on the cosine dependence of equation (1). The angles indicated represent an incident direction of sound over −180° to 180° from an axis of symmetry $L_S$. 325 indicates the response $P_L$ from, for example, first sound sensor 101 over the indicated incident direction, while 326 indicates the response $P_R$ from, for example, second sound sensor 102 over the indicated incident direction. The two responses 325 and 326 are shifted from each other by about 60 degrees due to the use of $\theta_{off}=30°$, and as before provide ambiguous results. However, FIG. 4 shows the theoretical direction of arrival and the corresponding sensor response when calculated as the difference $(\alpha_1 P_L-\alpha_2 P_R)$ divided by the sum $(\alpha_1 P_L+\alpha_2 P_R)$ of individual sensor outputs, as indicated by 427 and with $\alpha_1=\alpha_2$. As indicated, this formulation provides unambiguous direction finding between ±60° from normal incidence in the direction of the axis of symmetry $L_S$. Digital device 118 is programmed to determine the resulting $(\alpha_1 P_L-\alpha_2 P_R)/(\alpha_1 P_L+\alpha_2 P_R)$ based on received $P_L$ and $P_R$ signals, and determine the angle $\theta_S$ within of $\pm(90°-\theta_{off})$ from the axis of symmetry $L_S$ of Direction Finding Acoustic Sensor 100.

Figure 5:
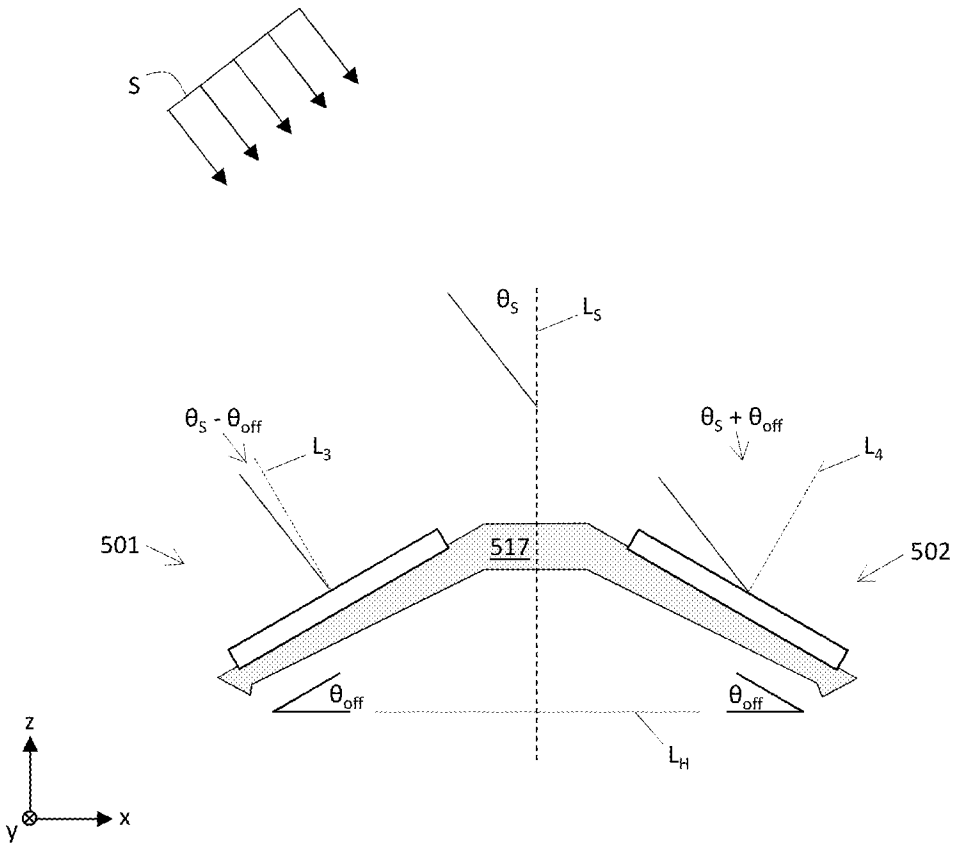
FIG. 5 illustrates another embodiment of the Direction Finding Acoustic Sensor.

As further illustration, FIG. 5 illustrates a first sound sensor 501 and second sound sensor 502 coupled by platform structure 517 with the previous relations between $L_3$, $L_4$, $L_S$, $L_H$, and $\theta_{off}$ as earlier described, and with the reference axes as shown. An incident sound S originates from a location having the general direction $\theta_S$ with respect to $L_S$, as indicated, where a value for $\theta_S$ is unknown and where is $\theta_S$ is generally within the x-z plane. At FIG. 5, each of first sound sensor 501 and second sound sensor 502 produce an output (P) cosine dependence as in equation (1) and both are symmetrically positioned at an offset angle $\theta_{off}$ by platform structure 517. Both sensors are co-located in close proximity to each other, such that the amplitude of sound pressure from incident sound S can be considered nearly the same at both sensors. Applying equation (1) to first sound sensor 501 and second sound sensor 502, the pressure experienced by the two sensors can be written as:

$$P_L=\alpha_1 P_0 \cos(\theta_S-\theta_{off});\ -90°+\theta_{off}\leq\theta_S\leq 90°-\theta_{off} \tag{2}$$

$$P_R=\alpha_2 P_0 \cos(\theta_S+\theta_{off});\ -90°+\theta_{off}\leq\theta_S\leq 90°-\theta_{off} \tag{3}$$

Combining the difference and sum of both returns and with $\alpha_1=\alpha_2$ allows for cancellation of the source level and resolution of angle ambiguity as follows:

$$\frac{P_L-P_R}{P_L+P_R}=\frac{P_0\cos(\theta_S-\theta_{off})-P_0\cos(\theta_S+\theta_{off})}{P_0\cos(\theta_S-\theta_{off})+P_0\cos(\theta_S+\theta_{off})}=\frac{P_o}{P_o}\left(\frac{\cos(\theta_S-\theta_{off})-\cos(\theta_S+\theta_{off})}{\cos(\theta_S-\theta_{off})+\cos(\theta_S+\theta_{off})}\right);\ -90°+\theta_{off}\leq\theta_S\leq 90°-\theta_{off} \tag{4}$$

such that:

$$\frac{P_L-P_R}{P_L+P_R}=\tan(\theta_{off})\tan(\theta_S) \tag{5}$$

or:

$$\theta_s=\tan^{-1}\left(\frac{1}{\tan(\theta_{off})}\frac{(P_L-P_R)}{(P_L+P_R)}\right);\ -90°+\theta_{off}\leq\theta_s\leq 90°-\theta_{off} \tag{6}$$

In practice, the dual sensor unit will be calibrated and the output normalized to balance any differences between individual sensors.

Amplitude detection device 116 may be any device which detects a displacement of for example right sensor wing 108 relative to support structure 112 and provides a signal proportional to the displacement sensed, and may rely on optical, electrical, or other parameters in order to sense the displacement. In a particular embodiment, amplitude detection device 116 comprises interdigitated comb-finger capacitors having a first set of comb fingers fixably attached to left wing 106 or right wing 108 sensor wing and a second set of comb fingers fixably attached to the support. See e.g. Downey et al, "Reduced Residual Stress Curvature and Branched Comb Fingers Increase Sensitivity of MEMS Acoustic Sensor," *Journal of Micromechanical Systems* 23(2) (2014), and see Michael Touse, "Design, fabrication, and characterization of a microelectromechanical directional microphone," (Ph.D. dissertation, Naval Postgraduate School, 2011), which are incorporated in their entirety. In alternate embodiments, amplitude detection device 116 employs an optical methodology such as Laser Doppler Vibrometry, grating interferometry, and others.

Additionally, as disclosed herein, "parallel" or "substantially parallel" means that a first direction vector is parallel to a first line and a second direction vector is parallel to a second line, and the angle between the first direction vector and the second direction vector is less than 5 degrees, preferably less than 2 degrees, and more preferably less than 1 degree. Similarly, when a surface is substantially parallel to the first line, this means that a 3$^{rd}$ direction vector is parallel to the surface and co-planer with the first line, and the angle between the first direction vector and the third direction vector is less than 5 degrees, preferably less than 2 degrees, and more preferably less than 1 degree. Additionally, when a first line is "co-planer" or "substantially co-planer," with a reference plane a first direction vector is parallel to a first line, this means the first direction vector is co-planer with the reference plane. Further, when a first line is "perpendicular" or "substantially perpendicular" to a second line, this means that a first direction vector is parallel to the first line and a second direction vector is parallel to the second line, and the angle between the first direction vector and the second direction vector is at least 80 degrees and more preferably at least 85 degrees.

EXAMPLE

In an exemplary Direction Finding Acoustic Sensor, a first sensor and a second sensor were established in the relative orientation of first sound sensor 501 and second sound sensor 502 of FIG. 5. Each sound sensor was intended to operate around 1.7 kHz and comprised two 1.2×1.2 mm$^2$ wings connected in the middle by a 3 mm×30 μm bridge. The entire structure was connected to a substrate by two torsional legs at the center. For electronic readout of nanoscale vibration amplitudes at typical sound pressures, a set of interdigitated comb finger capacitors was integrated at the edges of the wings. The comb fingers were designed in a fishbone architecture with a 200 μm long central spine with 20 μm long and 2 μm wide comb fingers on both sides. The gap between moving fingers attached to the wings and fixed fingers attached to the substrate was 2 μm. Using the dimensions of the comb finger capacitors, the total capacitance was mathematically estimated to be about 20 pF. In addition to the comb finger capacitors attached to the wings, a reference capacitor made of fixed electrodes with the same size was fabricated next to the sensor to allow differential measurement of the displacement using a MS3100 chip from the Irvine Sensors. The sensor was operated at the bending resonance frequency due to its larger amplitude of vibration. See Wilmott et al., "Bio-Inspired Miniature Direction Finding Acoustic Sensor," *Scientific Reports* 6 (2016).

Figure 6:
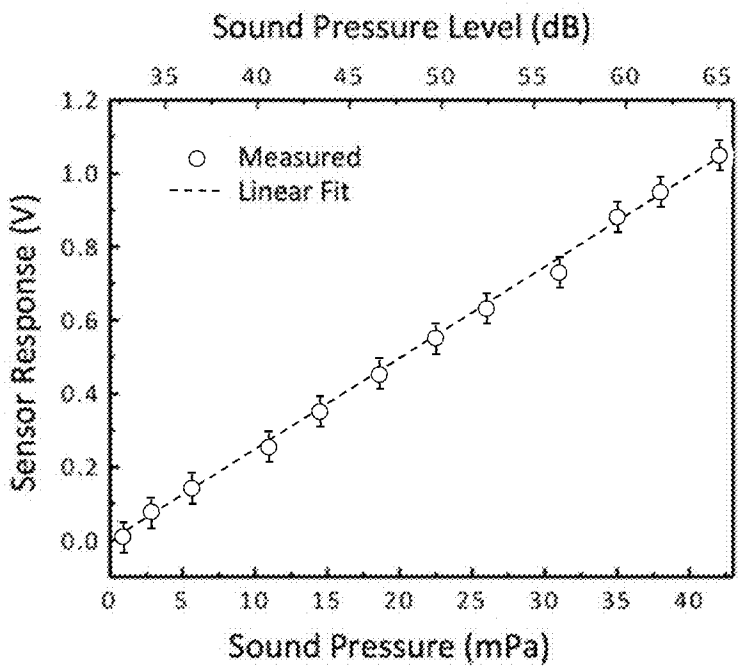
FIG. 6 illustrates exemplary response with sound pressure level of an individual sensor comprising an embodiment of the Direction Finding Acoustic Sensor.

The response of a single sound sensor was measured by varying sound pressure as shown in FIG. 6, using sound incident normal to the sensor wings of the single sound sensor to elicit maximum output. During the measurement, the sound frequency was set to 1.69 kHz. The data in FIG. 6 shows that the response has a linear dependence to sound pressure and the slope of the line gives sensitivity of about 25 V/Pa. This value was obtained at the bending frequency, measured directly at the output of the MS3110 readout chip. The readout chip was programmed using a feedback capacitance (CF) of 1.06 pF and an internal gain setting of 4 which gave a sensitivity of about 10 V/pF based on the formula given in the MS3110 manual. No external amplifiers were used.

Figure 7:
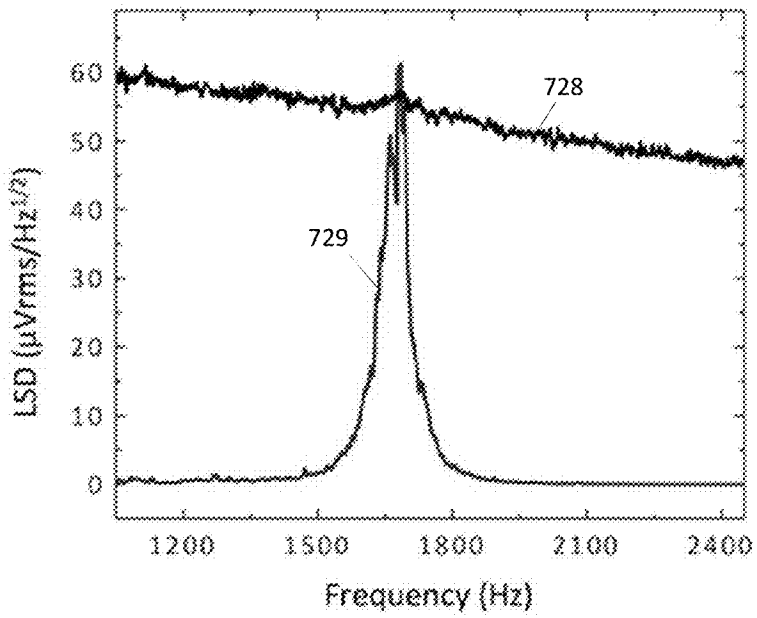
FIG. 7 illustrates electrical noise and mechanical noise of an individual sensor comprising an embodiment of the Direction Finding Acoustic Sensor.

The intrinsic mechanical noise of the single sound sensor is estimated to be about 11 dB primarily due to the vibration of the wings as a result of thermal agitations via surrounding air. The vibration amplitude as a function of sound frequency was measured using a laser vibrometer without external sound excitation, exhibiting a maximum of around 18 pm at the bending frequency. The peak mechanical sensitivity of the sensor was found to be about 25 μm/Pa. The amplitude of vibration was converted to linear spectral density and subsequently multiplied by the sensitivity of the sensor to translate the mechanical noise of the sensor to an equivalent electrical output. The combined electrical noise of the sensor and readout electronics was also measured in the same frequency range using a HP 3562A dynamic signal analyzer and the two voltage spectral densities are shown in FIG. 7. It can be seen in FIG. 7 that the electrical noise 728 is dominant over the readout signal 729 except at the resonance frequency of the sensor.

Figure 8:
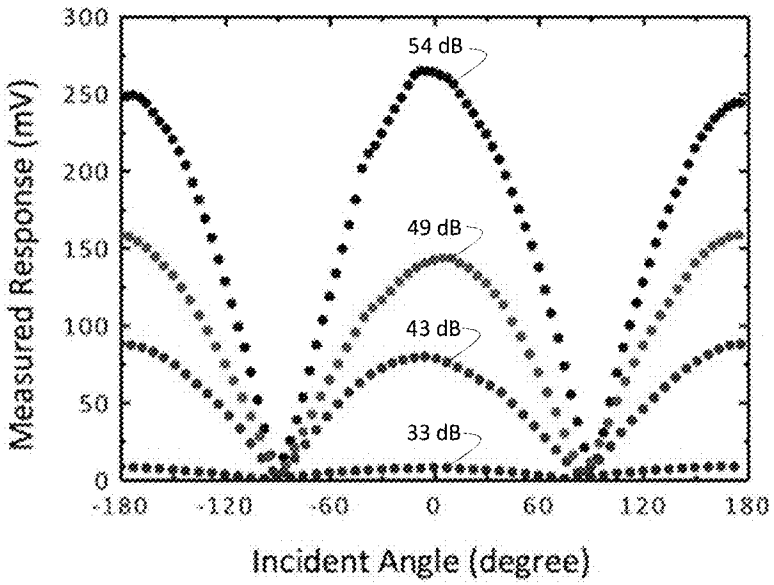
FIG. 8 illustrates measured directional response for various sound levels for of an individual sensor comprising an embodiment of the Direction Finding Acoustic Sensor.

Since the sound interacts with both sides of our MEMS sensor, it acts as a pressure gradient microphone with expected cosine dependence of the amplitude of vibration with direction of sound. If the incident sound pressure amplitude at the sensor is $P_o$, then the output voltage (V) as a function of incident angle has the form:

$$V=|\alpha P_o \cos\theta| \tag{7}$$

where $\alpha$ is a proportionality constant that depends on the parameters of the readout circuit and $\theta$ is the direction of arrival with respected to the normal. The output signal of the sensor was measured as the incident angle was varied from −180° to +180° for a set of sound pressures and the results are shown in FIG. 8 for the sound levels indicated, which agrees well with the expected cosine dependence given in equation (7). The directional response was observed for sound levels at the sensor down to 33 dB, which is close to the sound floor of the anechoic chamber used in the experiment. This indicates the high sensitivity of the comb finger electronic readout system.

In a two sound sensor Direction Finding Acoustic Sensor such as that illustrated at FIGS. 1 and 5, because each sensor produces an output (V) with cosine dependence as in equation (7) and both are symmetrically positioned at an offset angle $\theta_{off}$, the angle ambiguity can be solved. Both sensors are co-located in close proximity to each other, such that the amplitude of sound pressure, $P_o$ can be considered nearly the same at both sensors. Applying equation (7) to the first sound sensor 501 (index L) and the second sound sensor 502 (index R), the signal generated by the two sensors can be written as:

$$V_L=\alpha_L P_o \cos(\theta-\theta_{off}),\ \text{and}\ V_R=\alpha_R P_o \cos(\theta+\theta_{off}),\ \text{for}\ -90°+\theta_{off}\le\theta\le 90°+\theta_{off} \tag{8}$$

where $\alpha_L$ and $\alpha_R$ are calibration constants, which generally account for any mismatch between sensors and can be obtained by measuring the output of each sensor keeping sound pressure and incident angle the same. In certain embodiments, $\alpha_L$ and $\alpha_R$ are frequency dependent and based on an expected frequency of incoming sound. Taking the ratio of the difference and sum of normalized signals in equation (8), the unknown sound pressure amplitude can be eliminated to obtain the unknown angle using:

$$\frac{V_L/\alpha_L - V_R/\alpha_R}{V_L/\alpha_L + V_R/\alpha_R} = \tan(\theta_{off})\tan(\theta),\ \text{for}\ -90° + \theta_{off} \le \theta \le 90° + \theta_{off} \tag{9}$$

Using the measured electrical outputs of the two sensors ($V_L$ and $V_R$) and the corresponding proportionality constants ($V_L$ and $V_R$), the unknown angle can be readily obtained using equation (9). Because the sensor output is a measure of the magnitude of wing displacement, equation (9) is generally only valid within the specified range of angles as indicated.

Figure 9:
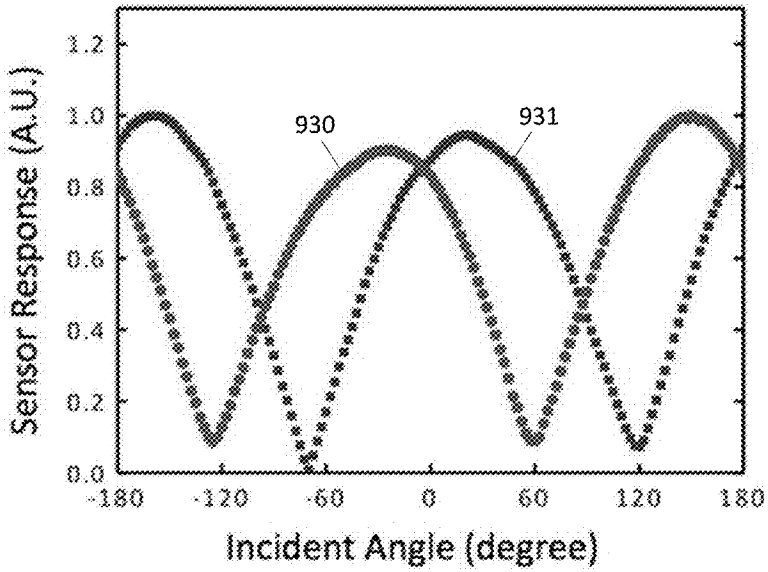
FIG. 9 illustrates the measured directional response of individual sensors comprising an embodiment of the Direction Finding Acoustic Sensor.
Figure 10:
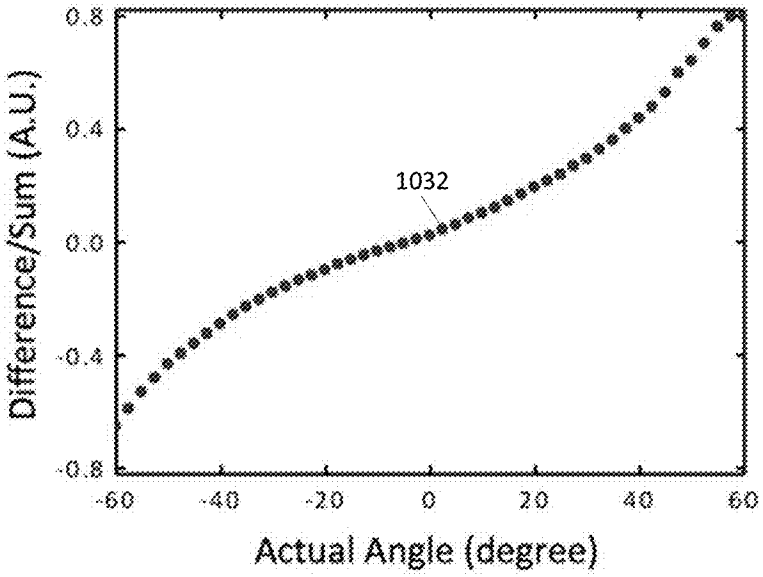
FIG. 10 illustrates response of an embodiment of the Direction Finding Acoustic Sensor.

Two sensors canted at a 30° offset angle were employed for determining their ability to uniquely determine the incident angle of sound. The selection of 30° offset angle was made to obtain a relatively wide angular range while keeping the difference/sum ratio at an appreciable range based on equation (9). It can be seen that smaller the canted angle wider the angular range but smaller the ratio due to nearly equal incident angles at the two sensors. Initially, angular dependence output of both sensors were measured for a sound pressure of 42 dB to determine the two proportionality constants ($\alpha_L$ and $\alpha_R$). FIG. 9 shows the measured normalized responses of the two sensors with the first sound sensor 501 response as 930 and the second sound sensor 502 response as 931, as a function of the incident angle of sound from −180° to +180° around $L_S$. The two responses are as expected shifted from each other by about 60 degrees due to the use of $\theta_{off}$=30°. The fact that the signals from the sensors do not always cross zero is most likely due to the detection of scattered sound from the fixtures used in mounting the sensor assembly. FIG. 10 shows the difference over sum ratio of the two normalized amplitudes for the range from −60 to +60° as 1032 where equation (9) is valid and which serves as the calibration curve for the two-sensor assembly. There, the data were not averaged, nevertheless they were directly derived from the curves provided in FIG. 9.

Figure 11:
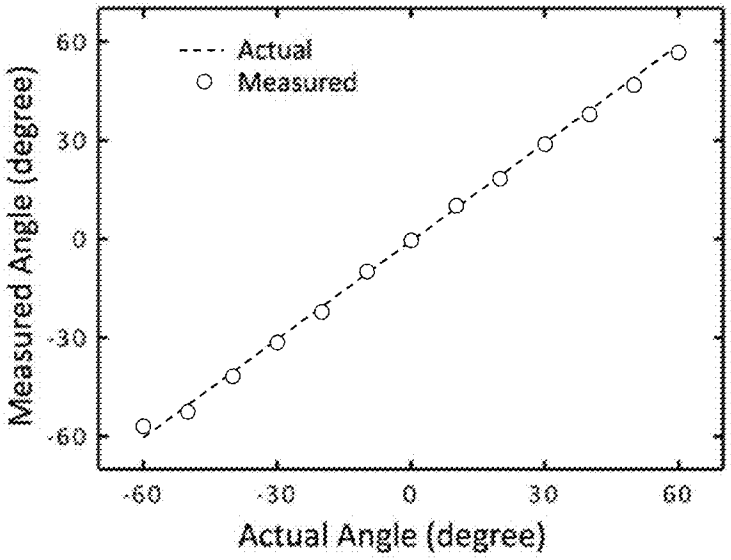
FIG. 11 illustrates measured and actual angles along an ideal response line.

Next, measurements were taken at 10° intervals over the range of ±60° around $L_S$ for a set of sound pressure levels (33, 35, 37.5, 42, 49 and 54 dB). It was found that the ratio of difference and sum of the normalized amplitudes hardly varied with the sound pressure due to the linearity of the sensor response with pressure (see FIG. 6). This indicates that the dual sensor assembly does not require a sound level measurement to determine the direction of incident sound. For comparison of measured with the actual at each of the angles, measured output of the sensors at the six sound levels were averaged and ratio of normalized difference over sum was used to determine the measured angle. FIG. 11 shows a comparison between measured and actual angles along with an ideal response line that corresponds to a 45° slope. Six measurements taken at each angle indicated minimal error close to the normal axis and maximum error of 3.4° as the angle of incidence increased to ±60°. Higher variation at larger angles is probably due to rapid increase of the ratio as the incident angle is increased making the determination of the angle less accurate.

The frequency response of the sensors was individually measured in an anechoic chamber by feeding the electrical output of the MS3110 chip to a lock-in amplifier. In order for the MS3110 to properly react to changes in capacitance at the sensor, it must be balanced using the built-in internal capacitors. The desired gain is set according to the expected capacitance variations and intended sound level. Here, the MS3110 was set to provide approximately 10 V/pF, where a pF corresponds a displacement of about 1 μm at the extremity of the sensor wing.

Figure 12:
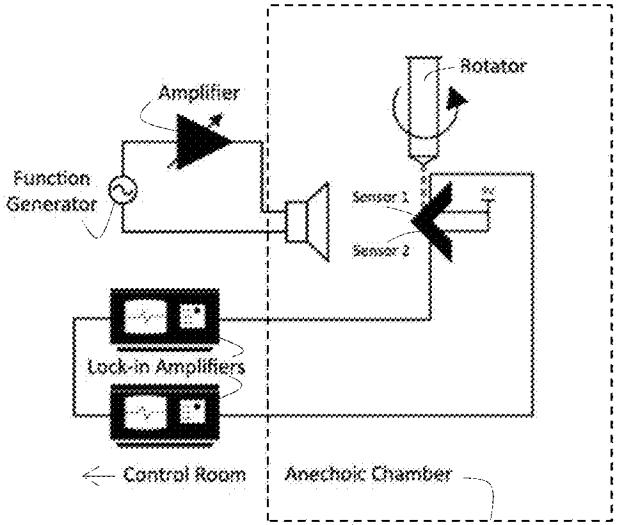
FIG. 12 illustrates an exemplary setup utilized for measurement of Direction Finding Acoustic Sensor response.

The lock-in amplifier was a Stanford Research System model SR 850DSP and it was set to lock in the frequency of the sound source. An Agilent 33220A function generator was connected to an HP 467A audio amplifier to allow control of the speaker Selenium DH 200E used as a sound source. The sound level was measured by a Brüel & Kjaer 2670 pressure field microphone. The instrumentation was placed outside the anechoic chamber. The sensors were placed on 3D printed (Polylactic Acid (PLA)) mount, to assure 30 degree offset. During the measurement, two circuit boards were placed very close to each other and the separation of the two sensors was about couple of millimeters. The mount was connected to a metallic post connected to a turntable. All wires passed through the turntable connection fixture. A schematic of the experimental setup used for the measurement of responses of the two sensors with angle and sound pressure is illustrated at FIG. 12.

The frequency of the excitation sound source was swept slowly to maintain the lock-in condition at all times. The sensor assembly was mounted on a remote controlled rotator 5 m away and at the same height as the speaker used for excitation. The sound was set to the desired levels while two lock-in amplifiers, one per each sensor channel, were used to capture the sensor output corresponds to excitation frequency of 1.69 kHz. The electrical noise measurements were performed connecting the output of the MS3110 chip to a HP 3652A dynamic signal analyzer. The sensor was kept inside the anechoic chamber during the measurement. The analyzer was set to provide the voltage spectral density for a frequency span of 800 Hz around the resonant frequency of the sensor. The measurement was repeated 100 times and averaged to provide the data shown in FIG. 7. The mechanical noise was measured using a Politec OFV-5000 laser vibrometer in the same frequency range.

Thus, provided here is a Direction Finding Acoustic Sensor comprising a first sound sensor and a second sound sensor, where the first and second sound sensors are generally maintained in a reflectional symmetry around an axis of symmetry. A digital device in data communication both sounds sensors is programmed to receive a signal $P_L$ from a first amplitude detection device and a signal $P_R$ from a second amplitude detection device based on displacement of the sensor wings of each sound sensor. The digital device performs direction finding by evaluating a difference between an $\alpha_1 P_L$ and an $\alpha_2 P_R$ relative to a sum of the $\alpha_1 P_L$ and the $\alpha_2 P_R$, where $\alpha_1$ and $\alpha_2$ are non-zero real numbers. The Direction Finding Acoustic Sensor provides an angle $\theta_S$ corresponding to the result. Typically, the Direction Finding Acoustic Sensor communicates the $\theta_s$ determined using some appropriate reference frame, such as the axis of symmetry. The Direction Finding Acoustic Sensor is capable of providing an unambiguous direction within an angle of $\pm(90°-\theta_{off})$ of the axis of symmetry.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. A Direction Finding Acoustic Sensor comprising:

a first sound sensor and a second sound sensor, where the first sound sensor and the second sound sensor individually comprise:

a sensor body, the sensor body comprising:

a left wing;

a right wing, where a first sensor axis intersects the left wing and the right wing, and where a second sensor axis is perpendicular to the first sensor axis; and a bridge coupling the left wing with the right wing;

a support structure connected to the sensor body, where the support structure is hollow beneath the sensor body, allowing the sensor body to vibrate upon sound excitation; and an amplitude detection device adapted to detect a displacement of the left wing, the right wing, or both the left wing and the right wing;

a platform structure coupled to the first sound sensor and coupled to the second sound sensor, and the platform structure maintaining the first sound sensor and the second sound sensor in an orientation where a $\theta_1$ is a subtended angle between an axis of symmetry and the second sensor axis of the first sound sensor and $\theta_2$ is a subtended angle between the axis of symmetry and the second sensor axis of the second sound sensor and where $-5° \leq (\theta_1 - \theta_2) \leq 5°$; and a digital device in data communication with the amplitude detection device of the first sound sensor and in data communication with the amplitude detection device of the second sound sensor, and the digital device programmed to perform steps comprising:

receiving a $P_L$ from the amplitude detection device of the first sound sensor, where the $P_L$ is proportional to a detected displacement of the left wing of the first sound sensor, the right wing of the first sound sensor, or both the left wing of the first sound sensor and the right wing of the first sound sensor relative to the support structure of the first sound sensor;

receiving a $P_R$ from the amplitude detection device of the second sound sensor, where the $P_R$ is proportional to a detected displacement of the left wing of the second sound sensor, the right wing of the second sound sensor, or both the left wing of the second sound sensor and the right wing of the first second sensor relative to the support structure of the second sound sensor;

evaluating a value of a fraction, where a numerator of the fraction comprises a difference between an $\alpha_1$ multiplied by the $P_L$ and an $\alpha_2$ multiplied by the $P_R$, and where a denominator of the fraction comprises a sum of the $\alpha_1$ multiplied by the $P_L$ and the $\alpha_2$ multiplied by the $P_R$, where $\alpha_1$ and $\alpha_2$ are non-zero real numbers; and assigning an angle $\theta_S$ based on the value of the fraction.

2. The Direction Finding Acoustic Sensor of claim 1 where the digital device is further programmed to determine a direction, where the direction is based on the angle $\theta_S$.

3. The Direction Finding Acoustic Sensor of claim 2 where the axis of symmetry is parallel to a z axis and an x axis is perpendicular to the z axis, and an angle $\theta_{off}$ is a subtended angle between the first sensor axis of the first sound sensor and the x axis, and where the digital device is programmed determine the direction such that an angle between the direction and the axis of symmetry is equal to or less than $\pm(90°-\theta_{off})$.

4. The Direction Finding Acoustic Sensor of claim 1 where the numerator comprises $(\alpha_1 P_L-\alpha_2 P_R)$ and the denominator comprises $(\alpha_1 P_L+\alpha_2 P_R)$.

5. The Direction Finding Acoustic Sensor of claim 4 where $0.9\leq\alpha_1/\alpha_2\leq1.1$.

6. The Direction Finding Acoustic Sensor of claim 1 where the axis of symmetry is parallel to a z axis and an x axis is perpendicular to the z axis, and where the first sensor axis of the first sound sensor, the first sensor axis of the second sound sensor, and the axis of symmetry are co-planer with an x-z plane comprising the x axis and the z axis.

7. The Direction Finding Acoustic Sensor of claim 6 where an angle $\theta_{off\text{-}1}$ is another subtended angle between the first sensor axis of the first sound sensor and the x axis, and an angle $\theta_{off\text{-}2}$ is an additional subtended angle between the first sensor axis of the second sound sensor and the x axis, and where $-5°\leq(\theta_{off\text{-}1}-\theta_{off\text{-}2})\leq5°$.

8. The Direction Finding Acoustic Sensor of claim 7 where the second sensor axis of the first sound sensor, the second sensor axis of the second sound sensor, and the axis of symmetry are co-planer with the x-z plane comprising the x axis and the z axis.

9. The Direction Finding Acoustic Sensor of claim 1 where the amplitude detection device of the first sound sensor comprises a first plurality of comb finger capacitors coupled to the left wing of the first sound sensor or the right wing of the first sound sensor and a second plurality of comb finger capacitors coupled to the support of the first sound sensor, where the first plurality of comb finger capacitors moveably interdigitate with the second plurality of comb finger capacitors.

10. A Direction Finding Acoustic Sensor comprising:

a first sound sensor and a second sound sensor, where the first sound sensor and the second sound sensor individually comprise:

a sensor body, the sensor body comprising:

a left wing;

a right wing, where a first sensor axis intersects the left wing and the right wing, and where a second sensor axis is perpendicular to the first sensor axis; and a bridge coupling the left wing with the right wing;

a support structure connected to the sensor body, where the support structure is hollow beneath the sensor body, allowing the sensor body to vibrate upon sound excitation; and an amplitude detection device adapted to detect a displacement of the left wing, the right wing, or both the left wing and the right wing;

a platform structure coupled to the first sound sensor and coupled to the second sound sensor, and the platform structure maintaining the first sound sensor and the second sound sensor in an orientation where $\theta_1$ is a subtended angle between an axis of symmetry and the second sensor axis of the first sound sensor and $\theta_2$ is a subtended between the axis of symmetry and the second sensor axis of second sound sensor and where $-5°\leq(\theta_1-\theta_2)\leq5°$, and where the axis of symmetry is parallel to a z axis and an x axis is perpendicular to the z axis, and where the first sensor axis of the first sound sensor, the first sensor axis of the second sound sensor, and the axis of symmetry are co-planer with an x-z plane comprising the x axis and the z axis, and where an angle $\theta_{off}$ is a subtended angle between the first sensor axis of the first sound sensor and the x axis; and a digital device in data communication with the amplitude detection device of the first sound sensor and in data communication with the amplitude detection device of the second sound sensor, and the digital device programmed to perform steps comprising:

receiving a $P_L$ from the amplitude detection device of the first sound sensor, where the $P_L$ is proportional to a detected displacement of the left wing of the first sound sensor, the right wing of the first sound sensor, or both the left wing of the first sound sensor and the right wing of the first sound sensor relative to the support structure of the first sound sensor;

receiving a $P_R$ from the amplitude detection device of the second sound sensor, where the $P_R$ is proportional to a detected displacement of the left wing of the second sound sensor, the right wing of the second sound sensor, or both the left wing of the second sound sensor and the right wing of the second sound sensor relative to the support structure of the second sound sensor;

evaluating a value of a fraction, where a numerator of the fraction comprises a difference between an $\alpha_1$ multiplied by the $P_L$ and an $\alpha_2$ multiplied by the $P_R$, and where a denominator of the fraction comprises a sum of the $\alpha_1$ multiplied by the $P_L$ and the $\alpha_2$ multiplied by the $P_R$, where $\alpha_1$ and $\alpha_2$ are non-zero real numbers;

assigning an angle $\theta_S$ based on the value of the fraction; and determining a direction, where the direction is based on the angle $\theta_S$, and where the direction is such that an angle between the direction and the axis of symmetry is equal to or less than $\pm(90°-\theta_{off})$.

11. The Direction Finding Acoustic Sensor of claim 10 where the second sensor axis of the first sound sensor, the second sensor axis of the second sound sensor, and the axis of symmetry are co-planer with the x-z plane comprising the x axis and the z axis.

12. The Direction Finding Acoustic Sensor of claim 11 where an angle $\theta_{off\text{-}1}$ is a subtended angle between the first sensor axis of the first sound sensor and the x axis, and an angle $\theta_{off\text{-}2}$ is a subtended angle between the first sensor axis of the second sound sensor and the x axis, and where $-5°\leq(\theta_{off\text{-}1}-\theta_{off\text{-}2})\leq5°$.

13. The Direction Finding Acoustic Sensor of claim 12 where the numerator comprises $(\alpha_1 P_L-\alpha_2 P_R)$ and the denominator comprises $(\alpha_1 P_L+\alpha_2 P_R)$.

14. The Direction Finding Acoustic Sensor of claim 13 where $0.9\leq\alpha_1/\alpha_2\leq1.1$.

15. The Direction Finding Acoustic Sensor of claim 14 where the amplitude detection device of the first sound sensor comprises a first plurality of comb finger capacitors coupled to the left wing of the first sound sensor or the right wing of the first sound sensor and a second plurality of comb finger capacitors coupled to the support of the first sound sensor, where the first plurality of comb finger capacitors moveably interdigitate with the second plurality of comb finger capacitors.

* * * * *